US006917148B2

(12) United States Patent
Ricaud et al.

(10) Patent No.: US 6,917,148 B2
(45) Date of Patent: Jul. 12, 2005

(54) OXIDE CATHODE FOR AN ELECTRON GUN, HAVING A DENSER AND THINNER EMISSIVE ZONE

(75) Inventors: Jean-Luc Ricaud, Dijon (FR); Gérard Proudhon, Chevigny Saint Sauveur (FR)

(73) Assignee: Thomson Licensing S. A., Boulogne-Billancourt (FR)

( * ) Notice: Subject to any disclaimer, the term of this patent is extended or adjusted under 35 U.S.C. 154(b) by 118 days.

(21) Appl. No.: 10/421,591

(22) Filed: Apr. 23, 2003

(65) Prior Publication Data

US 2003/0201705 A1 Oct. 30, 2003

(30) Foreign Application Priority Data

Apr. 25, 2002 (FR) ..... 02 05183

(51) Int. Cl.[7] ..... H01J 1/20

(52) U.S. Cl. ..... 313/346 R; 313/346 DC; 313/337; 313/310; 313/411; 313/441; 313/446; 445/46

(58) Field of Search ..... 313/346 R, 349, 313/346 DC, 337, 270, 454, 411, 456; 445/46

(56) References Cited

U.S. PATENT DOCUMENTS 5,808,404 A * 9/1998 Koizumi et al. ..... 313/346 R
6,252,341 B1 * 6/2001 Hasegawa et al. ..... 313/346 R
6,351,061 B1 2/2002 Yamauchi et al. ..... 313/346
6,376,976 B1 * 4/2002 Saitoh et al. ..... 313/346 R
2003/0011294 A1 * 1/2003 Komiya et al. ..... 313/454

FOREIGN PATENT DOCUMENTS

EP 0915492 A1 5/1999
JP 07249366 A * 9/1995 ..... H01J/1/28
JP 2002260522 A * 9/2002 ..... H01J/1/20

* cited by examiner

*Primary Examiner*—Nimeshkumar D. Patel
*Assistant Examiner*—Sikha Roy
(74) *Attorney, Agent, or Firm*—Joseph S. Tripoli; Harvey D. Fried; Richard LaPeruta, Jr.

(57) ABSTRACT

Cathode comprising a substrate (2) supporting a cathode emissive coating, comprising what is called an emissive central zone (12) and what is called a nonemissive peripheral zone (11); according to the invention:

the average density and the emissive zone (12) is greater than that in said nonemissive zone (11), the average thickness in the emissive zone (12) is less than that in the nonemissive zone (11).

In this way it is possible to significantly limit the drift in cut-off voltage, while still maintaining good maximum emission performance in DC mode and in pulse mode.

15 Claims, 3 Drawing Sheets

OXIDE CATHODE FOR AN ELECTRON GUN, HAVING A DENSER AND THINNER EMISSIVE ZONE

FIELD OF THE INVENTION

The invention relates to thermionic cathodes based on oxides, which are widely used as electron sources in electron guns for cathode-ray tubes, especially for computer monitors or television screens.

BACKGROUND ART

Referring to FIG. 1, a conventional oxide cathode K comprises:

- a cathode emissive coating 1 essentially composed of alkaline-earth oxides;
- a metal substrate 2 on which the cathode emissive coating is deposited, which substrate is generally based on nickel and/or a nickel alloy, containing elements for reducing the alkaline-earth oxides, such as magnesium and silicon;
- a hollow tubular skirt 3 supporting the substrate; and
- a filament 4 placed in the skirt 3, suitable for heating the substrate 2 and the cathode emissive coating 1 under vacuum to a temperature sufficient for this coating to emit electrons.

The cathode emissive coatings are generally porous, especially because they are generally made by thermal decomposition of carbonates of alkaline-earth elements into oxides of these elements; before decomposition, their thickness is generally between 53 and 95 $\mu$m, so as to obtain, after decomposition, an oxide coating having a thickness of between 50 and 90 $\mu$m.

The thickness of the substrate 2 is generally between 70 and 150 $\mu$m.

The skirt and the substrate may be produced from the same metal piece—the cathode is then referred to as a "one-piece" cathode.

Such cathodes are used in electron guns, especially for cathode-ray tubes; an electron gun conventionally comprises:

- a triode, shown in FIG. 1, suitable for forming an electron beam, comprising a cathode K, a first electrode G1 or Wehnelt pierced by a hole 52 forming the base of said electron beam and a second electrode G2 also pierced by a hole for passage of the electrons of the beam; and
- means (not shown) for focusing the electron beam coming from the triode, generally comprising a series of electrodes suitable for this purpose.

The electrode closest to the cathode, or Wehnelt G1, has a plane surface 51 lying parallel to the external surface of the cathode emissive coating 1 and at a distance from this surface of around 50 to 80 $\mu$m when the gun is in operation.

The hole 52 in the Wehnelt G1 of the triode may be circular, elliptical or even rectangular; the cathode and the electrode G1 of the triode are positioned so that the center of the cathode emissive coating coincides approximately with the center of the hole 52 in this electrode; two zones are therefore distinguished in the cathode emissive coating:

- a central zone 12 corresponding to the zone facing the hole 52 in the electrode G1, and therefore having the same shape as this hole, as indicated by the dotted lines on either side of the axis of symmetry in FIG. 1; and
- a peripheral lateral zone 11 corresponding to the entire cathode emissive coating except for the central zone.

The tube of a conventional color television with a shadow mask comprises in general a triple triode including three cathodes, one per primary color—red, green and blue; for each cathode, the electron beam current is generally around 0.4 to 0.8 mA averaged over time; for maximum luminances, this current may typically be up to 5 mA and the entire emissive surface of the cathode is then used; in the case of circular holes in the electrode G1, for example with a diameter of 0.5 mm, the potentially emissive zone of the cathode is then also circular and has the same diameter.

When the triode is in operation, it is therefore the voltage difference applied between the substrate 2 of the cathode and the Wehnelt G1 which serves to modulate the cathode emission; the triode also includes an electrode G2, further away from the cathode than the electrode G1 along the trajectory of the electrons; when the triode is in operation, the electrode G2 is biased so as to exert on the cathode a positive constant electric field for extracting the electrons, whereas the electrode G1 is biased so as to exert a negative adjustable field; in practice, the central zone 12 corresponds to the maximum extent of the electron-emitting zone that is obtained for the lowest voltage differences between the cathode and the electrode G1 this central, potentially emissive, zone will therefore be called hereafter, and by extension, the "emissive zone"; by analogy, the peripheral zone will therefore be called hereafter the "nonemissive zone".

The voltage difference between the substrate and the Wehnelt, for which the cathode emission is reduced to zero is usually called the "cut-off voltage".

Throughout the lifetime of a cathode, it is known that the cut-off voltage drifts, and this degrades the emission performance of the gun or requires an expensive compensation system.

The emission performance of a cathode is moreover expressed in terms of "maximum emission in pulse mode" and in terms of "maximum emission in DC mode".

The maximum emission in pulse mode corresponds to the maximum surface current density of the cathode emissive coating that can be achieved during a voltage pulse of short duration, of around 10 $\mu$s, applied to the grid G1; for cathode emissive coatings whose thickness is between 50 $\mu$m and 90 $\mu$m, the maximum emission in pulse mode of a cathode is essentially proportional to the thickness of its cathode emissive coating and generally depends little on the porosity of this coating.

The maximum emission in DC mode corresponds to the maximum surface current density of the cathode emissive coating that can be reached during a voltage pulse of long duration, of the order of 10 s, applied to the grid G1; the maximum emission in DC mode of a cathode is essentially proportional to the conductivity of its cathode emissive coating measured through its thickness; this maximum DC emission is therefore essentially inversely proportional to the thickness and proportional to the porosity of this coating.

During the lifetime of a cathode, the porosity and the thickness of its cathode emissive coating decrease by a sintering effect; overall, the conductivity of this coating decreases, thereby causing the maximum emission in DC mode to be lowered.

On the other hand, during the lifetime of a cathode, the maximum emission in pulse mode degrades less than the maximum emission in DC mode.

The cut-off voltage drift stems in particular from the variation in the distance separating the cathode emissive coating of the gate G1 from the electron gun; this distance varies especially because the porous cathode emissive coating shrinks by sintering; this shrinkage is greater the greater the initial thickness and/or the greater the porosity of the coating.

To recapitulate:

a high porosity results in an improvement in the maximum emission in DC mode but a degradation in the cut-off voltage drift; and a high thickness results in an improvement in the maximum emission in pulse mode but a degradation in the maximum emission in DC mode and in the cut-off voltage drift.

It may therefore be seen that one is faced with a dilemma regarding the optimum definition of the thickness and of the porosity of the cathode emissive coating; the object of the invention is to solve this dilemma.

SUMMARY OF THE INVENTION

For this purpose, the subject of the invention is an oxide cathode for an electron gun, comprising a substrate supporting a porous cathode emissive coating based on one or more alkaline-earth oxides, comprising what is called an emissive central zone and what is called a nonemissive peripheral zone, wherein:

the average density of this coating in said emissive zone is greater than that of this same coating in said nonemissive zone;

the average thickness of said coating in the emissive zone is less than that of this same coating in the nonemissive zone.

The expression "porous cathode emissive coating based on one or more alkaline-earth oxides" is understood to mean a coating consisting itself of a cathode emissive substance, in this case based on alkaline-earth oxides; a porous conducting element impregnated with a cathode emissive substance, in which the conducting element is generally based on tungsten, should not be included within this meaning; such a cathode emissive element is not based on alkaline-earth oxides but based on tungsten; such an impregnated conducting element is used in what are referred to as "impregnated" cathodes, this differing from the field of the invention, which relates to what are referred to as "oxide" cathodes.

Thanks to the morphology of the cathode emissive coating specific to the invention, it is possible to significantly limit the cut-off voltage drift, while still maintaining good performance in terms of maximum emission in DC mode and in pulse mode.

The invention may also have one or more of the following features:

the emissive zone comprises a part of which, simultaneously, the thickness is at least 10% less than the average thickness in the nonemissive zone and the density is at least 10% greater than the average density in the nonemissive zone; preferably, this part comprises the center of the emissive zone; if the emissive zone is circular, it is the center of the circle that forms this zone; if the emissive zone is of any shape, it is the centroid that forms this zone;

the external surface of the emissive zone is concave and the interface between the substrate and said cathode emissive coating is plane; preferably, the concavity is of spherical shape; because of the spherical surface of the emissive surface of the cathode, the length of the region of convergence of the trajectory of the electrons emitted by this cathode is reduced, thereby making it possible to improve the performance of the electron tube in which this cathode is incorporated;

the interface between said substrate and said emissive zone is convex and the external surface of the cathode emissive coating is approximately plane;

the thickness of said cathode emissive coating is at all points between 30 $\mu$m and 90 $\mu$m;

the difference in average density of this coating between said emissive zone and said nonemissive zone is greater than or equal to 0.1 g/cm$^3$.

the difference between the maximum thickness in said nonemissive zone and the minimum thickness in said emissive zone is greater than or equal to 20 $\mu$m; and the thickness of said substrate is uniform.

The subject of the invention is also an electron gun triode suitable for forming at least one electron beam, comprising one cathode per beam to be formed, a first electrode or "Wehnelt" pierced by a hole facing each cathode, in order to form the base of each electron beam, and a second electrode also pierced by a hole facing each hole in said Wehnelt for passage of the electrons of each beam, wherein each cathode is in accordance with the invention; preferably, for each cathode, the emissive zone corresponds to the zone facing the hole in said electrode and a peripheral zone corresponds to the entire cathode emissive coating except for the emissive zone.

The subject of the invention is also an electron gun comprising, as electron source, a cathode or a triode according to the invention.

The subject of the invention is also a cathode ray tube comprising at least one electron gun according to the invention.

BRIEF DESCRIPTION OF THE DRAWINGS

The invention will be more clearly understood on reading the description which follows, given by way of nonlimiting example and with reference to the appended figures in which.

DESCRIPTION OF THE PREFERRED EMBODIMENTS

To simplify the description and to bring out the differences and advantages afforded by the invention compared with the prior art, identical references are used for the elements fulfilling the same function.

Figure 1:
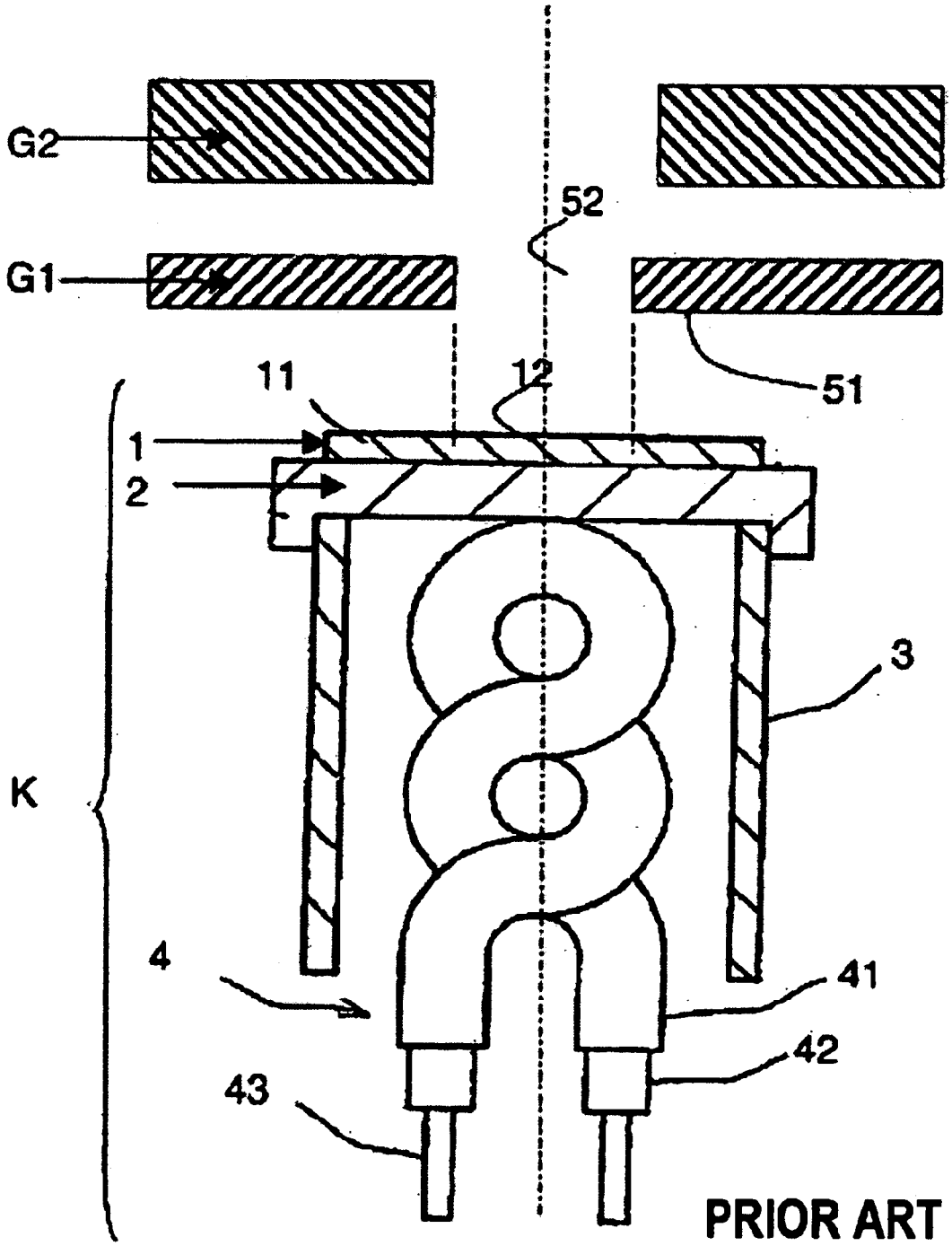
FIG. 1, already described, shows a triode for an electron gun.
Figure 2:
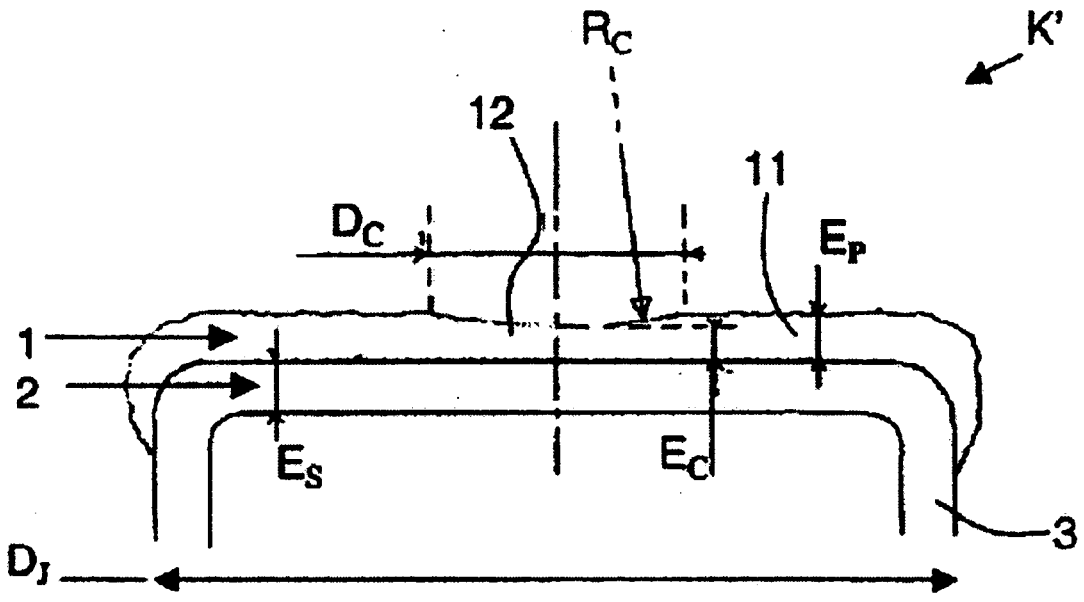
FIGS. 2 and 3 illustrate a cathode according to the invention, in a first and a second embodiment, respectively.

FIG. 2 illustrates the upper part of an oxide cathode K' according to a first embodiment of the invention, comprising a metal substrate 2 of uniform thickness $E_S$ supporting a porous cathode emissive coating 1 based on one or more alkaline-earth oxides, having what is referred to as an emissive central circular zone 12 of diameter $D_C$ and what is referred to as a nonemissive peripheral zone 11, also circular, of uniform thickness $E_P$; only the upper part of the skirt 3, of diameter $D_J$, is shown; the outside diameter of the peripheral zone 11 corresponds approximately to the diameter $D_J$ of the skirt 3; according to this embodiment, the external surface of the emissive zone 12 is concave, that is to say the center of the radius of curvature $R_C$ of this zone is located on the same side as the electron emission; according to this embodiment, the interface between the substrate 2 and the cathode emissive coating 1 is plane; thus, the average thickness of the coating 1 in the emissive zone 12 is less than that $E_P$ of this same coating in the nonemissive zone 11; here, the concavity of the external surface of the emissive zone 12 has the shape of a spherical cap which joins onto the plane surface of the nonemissive peripheral zone 11; the difference between the thickness $E_P$ in the nonemissive zone 11 and the minimum thickness $E_C$ at the center of the emissive zone is greater than or equal to 10 $\mu$m; if, for example, $E_P-E_C=20$ $\mu$m and if $D_C=0.45$ mm, then $R_C^2=(225)^2+(R-20)^2$, the radius of curvature in the concave zone is then $R_C=1.276$ mm.

According to the invention, the average density of the cathode emissive coating in the emissive zone 12 is greater than that of this same coating in the nonemissive zone 11.

A process for obtaining the cathode according to the embodiment of the invention that has just been described will now be described.

To manufacture this cathode, a circular tube of external diameter $D_J=1.4$ mm is used, said tube being closed at one end by a flat end wall of uniform thickness and the external surface of which will serve as the substrate 2 for the cathode emissive coating; the walls of the tube form the skirt 3; the thickness $E_S$ of the end wall is, for example, 100 $\mu$m; this end wall is in this case a bimetal comprising two coatings, the external coating being based on nickel doped with elements for reducing alkaline-earth oxides, such as magnesium, silicon and tungsten; according to a variant, this end wall may be made of a nickel alloy.

A coating based on alkaline-earth carbonates, having a uniform thickness of 95 $\mu$m and a density of 0.85 g/cm$^3$ is applied to this substrate 2 in a manner known per se; among the alkaline-earth elements, it is preferred to choose barium, strontium or possibly calcium.

Using a punch with a convex head, a concave hollow of 22 $\mu$m depth is produced at the center of the deposited coating; if the convexity of the head of the punch is in this case spherical in shape and if its radius of curvature is about $R_C=1.276$ mm, the punched zone of the carbonate coating is circular and has a diameter $D_C$ of 0.45 mm.

The conditions for the latter operation, especially the pressure applied to the punch, are tailored in a manner known per se in order for the average density of the carbonate coating in the punched central zone to be greater than that of this same coating in the unpunched peripheral zone. It should be noted that it is necessary to avoid the pressing conditions that are described in document U.S. Pat. No. 6,351,061, column 4, line 54 to column 5, line 6, in which, on the contrary, it is recommended, by limiting the pressure of the punch, to avoid modifying the density of the carbonate coating beneath the punch.

The average density of the carbonate coating in the punched central zone then depends on the reduction in volume of this zone during punching:

initial volume of the central zone: $V_{Ci}=E_P\pi D_C^2/4=0.0143$ mm$^3$;

volume reduction relating to punching:

$$\Delta V=\pi(E_P-E_C)^2(3R_C-E_P+E_C)/3=0.0016 \text{ mm}^3;$$

final volume of the central zone: $V_{Cf}=V_{Ci}-\Delta V=0.0127$ mm$^3$.

The average density of the carbonate coating in the central zone is then $0.85\times(V_{Cf}/V_{Ci})=0.96$ g/cm$^3$, i.e. an 11% reduction. This is the average density in this zone, the absolute density being liable to vary within this zone according to the distribution in the pressure during punching.

At the center of the punched zone, the thickness of the carbonate coating is at least 10% less than the average thickness in the unpunched zone and the density is at least 10% greater than the average density in the unpunched zone; these proportions are respected after decomposition of the carbonates, during operation of the cathode.

Advantageously, the punching is carried out after mounting the triode in which the cathode has to be incorporated and the holes in the electrodes G1 and G2 of this triode are used to guide the punch during pressing; this ensures very good centering of the punched zone with respect to the holes in the electrodes.

Other shapes of concavity may be envisioned without departing from the invention, for example a cylindrical concavity using a punch with an ovoid head; it is also possible to use punches whose head is not axi-symmetric but has two perpendicular planes of symmetry, especially in the case in which the Wehnelt G1 has a rectangular hole.

The cathode thus obtained is incorporated into a conventional triode, which is itself incorporated into a conventional electron gun, itself incorporated under vacuum into an electron tube; after this cathode has been activated, the carbonate coating is converted into a cathode emissive coating 1 based on alkaline-earth oxides, having a central emissive zone 12 corresponding to the punched zone and a nonemissive zone 11 corresponding to the unpunched zone; the decomposition of the carbonates results in a slight contraction in the dimensions of the coating, of around 5%.

The characteristics of this cathode emissive coating 1 are then:

uniform thickness $E_P$ of the nonemissive zone: 90 $\mu$m;

minimum thickness $E_C$ in the hollow of the emissive zone: 70 $\mu$m, i.e. a reduction of at least 20% relative to $E_P$;

average density $D_P$ of the nonemissive zone: 0.85 g/cm$^3$; and average density $D_C$ of the emissive zone: 0.96 g/cm$^3$.

Thus, the average thickness of this coating in the emissive zone 12 is less than that of this same coating in the nonemissive zone 11 and the average density of this coating in the emissive zone 12 is greater than that of this same coating in the nonemissive zone 11.

Thanks to the morphology of the cathode emissive coating specific to the invention, the voltage cut-off drift can be significantly limited, whilst still maintaining good maximum emission performance in DC mode and in pulse mode.

Such overall better performance results, it would seem, from the fact that the cut-off voltage drift depends more on the characteristics of a central portion of the emissive zone of the cathode emissive coating—of higher density and of lower thickness according to the invention, whereas the emission performance depends more on the characteristics of the perimeter of the emissive zone or of the nonemissive peripheral zone, because the rings of emissive zone that lie on this perimeter have more weight in the total emitted current and because the neighboring nonemissive zone provides this perimeter with a resource of cathode emissive barium.

Figure 4:
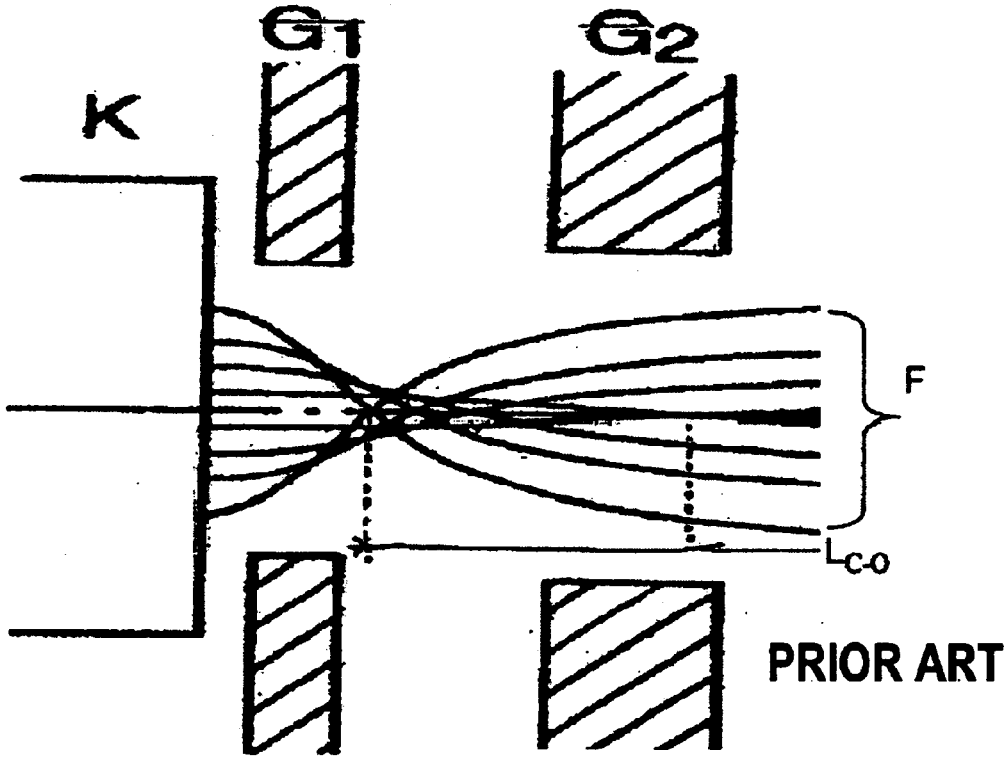
FIGS. 4 and 5 describe the trajectories of the electrons emitted by a cathode according to the prior art and according to the first embodiment of the invention, respectively.
Figure 5:
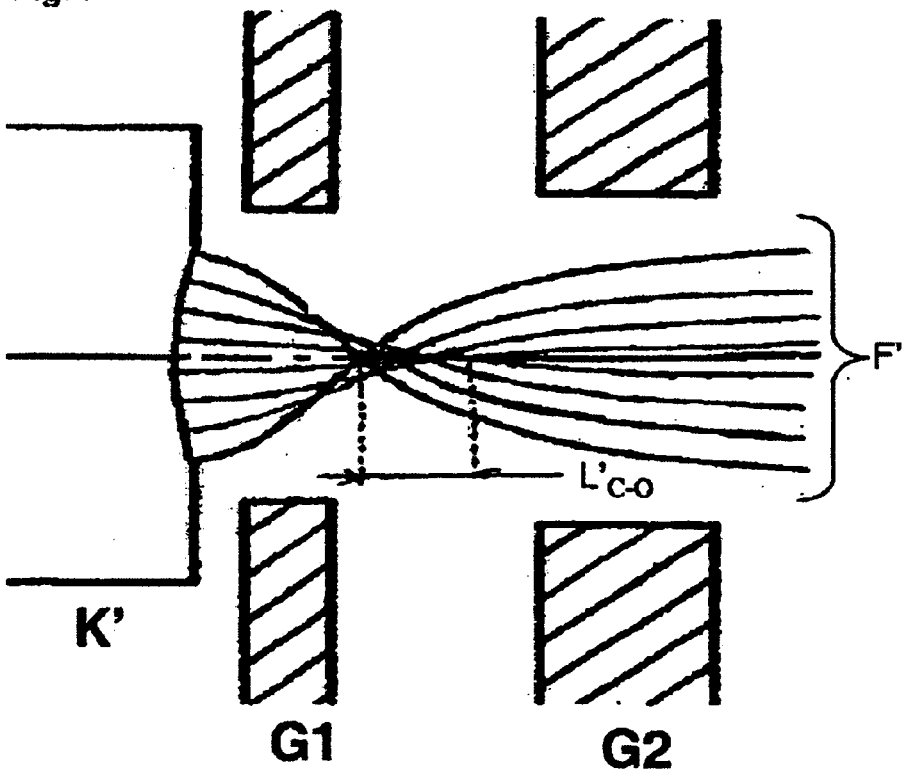

An additional advantage results from the concave shape of the surface of the emissive zone, especially its spherical shape, as explained above with reference to FIG. 4, which shows the electron beam F emitted by a conventional cathode K, and to FIG. 5, which illustrates the electron beam F' emitted by a cathode K' according to the invention having a concave emissive zone surface.

Because of the shape of the equipotential surfaces created facing the surface of the emissive zone of the cathode K or K' by the potentials applied to the neighboring electrodes, especially those of the triode G1 and G2, the trajectories of the electrons emitted by this cathode converge within a convergence region that extends, along the axis of the beam F or F', with a length $L_{C-O}$ or $L'_{C-O}$; this convergence region is also called the "crossover" region.

As illustrated in FIG. 5, compared with FIG. 4 it may be seen that, thanks to the concave, especially spherical, shape of the surface of the emissive zone of the cathode K', the length of the crossover region of a cathode according to the invention is less than that of the crossover region of a conventional cathode, thereby reducing the size of the spot and improving the performance, especially in terms of resolution, of a cathode ray tube when it is provided with such a cathode according to the invention.

Figure 3:
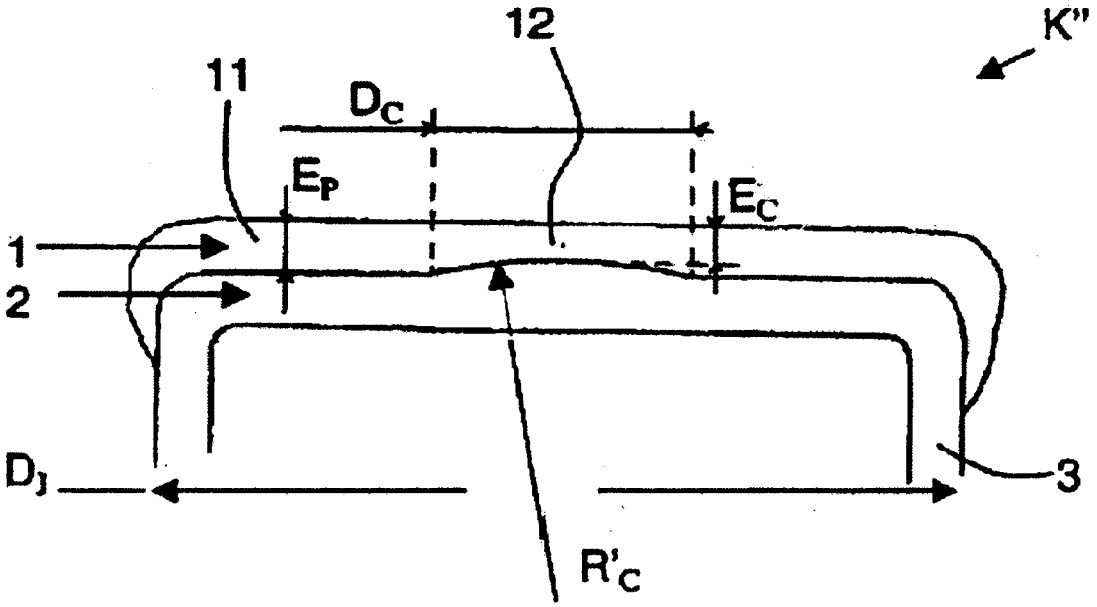

FIG. 3 illustrates the upper part of an oxide cathode K" according to a second embodiment of the invention, comprising the same components as the cathode described above, referenced in the same way; according to this embodiment, the interface between the substrate 2 and the emissive zone 11 is convex, that is to say the center of the radius of curvature $R'_C$ of this zone lies on the opposite side of the emission of the electrons; according to this embodiment, the external surface of the cathode emissive coating 1 is approximately plane; thus, the average thickness of the coating 1 in the emissive zone 12 is less than that $E_P$ of this same coating in the nonemissive zone 11; in this case, the convexity of the interface between the substrate 2 and the emissive zone 11 has the shape of a spherical cap which joins up with the plane surface of the interface between the substrate 2 and the nonemissive zone 11; the difference between the thickness $E_P$ in the nonemissive zone 11 and the minimum thickness $E_C$ at the center of the emissive zone is, as previously, greater than or equal to 10 $\mu$m.

According to the invention, the average density of the cathode emissive coating in the emissive zone 12 is greater than that of this same coating in the nonemissive zone 11.

A process for obtaining the cathode according to the embodiment of the invention that has just been described will now be described.

To manufacture this cathode, a circular tube of external diameter $D_J$=1.4 mm is used, this tube being closed at one end by an end wall having a convex central zone corresponding to the position of the future emissive zone 12; the thickness of the end wall is uniform, for example of the order of 100 $\mu$m; this end wall is in this case a bimetal, as previously.

A coating of uniform thickness based on alkaline-earth carbonates, with a thickness of 90 $\mu$m and a density of 0.85 g/cm$^3$, is applied in a manner known per se to this end wall with a convex central zone or substrate 2; at this stage of the process, the coating obtained therefore has a nonplanar external surface having a convex central zone corresponding to that of the substrate 2.

The center of the carbonate coating is flattened using a punch with a flat head, so as to obtain a carbonate coating having a central zone of greater density and of smaller thickness than those of the rest of the coating.

Other convex shapes may be envisioned without departing from the invention.

The cathode thus obtained is incorporated into a conventional triode, itself incorporated into a conventional electron gun, itself incorporated under vacuum into an electron tube; after this cathode has been activated, the carbonate coating is converted into a cathode emissive coating 1 based on alkaline-earth oxides, having a central emissive zone 12 corresponding to the flattened zone and a nonemissive zone 11 corresponding to the unflattened zone.

Thus, the average thickness of this coating in the emissive zone 12 is less than that of this same coating in the nonemissive zone 11 and the average density of this coating in the emissive zone 12 is greater than that of this same coating in the nonemissive zone 11.

As previously, it is possible to significantly limit the cut-off voltage drift, while still maintaining good maximum emission performance in DC mode and in pulse mode.

What is claimed is:

1. An oxide cathode for an electron gun, comprising a substrate supporting a porous cathode emissive coating based on one or more alkaline-earth oxides, comprising what is called an emissive central zone and what is called a nonemissive peripheral zone, wherein:

the average density of this coating in said emissive zone is greater than that of this same coating in said nonemissive zone;

the average thickness of said coating in the emissive zone is less than that of this same coating in the nonemissive zone.

2. The cathode as claimed in claim 1, wherein said emissive zone comprises a part of which, simultaneously, the thickness is at least 10% less than the average thickness in the nonemissive zone and the density is at least 10% greater than the average density in the nonemissive zone.

3. The cathode as claimed in claim 2, wherein said part of the emissive zone comprises the center of the emissive zone.

4. The cathode as claimed in claim 1, wherein the external surface of said emissive zone is concave and wherein the interface between said substrate and said cathode emissive coating is plane.

5. The cathode as claimed in claim 4, wherein said concavity is of spherical shape.

6. The cathode as claimed in claim 1, wherein the interface between said substrate and said emissive zone is convex and wherein the external surface of the cathode emissive coating is approximately plane.

7. The cathode as claimed in claim 1, wherein the thickness of said cathode emissive coating is at all points between 30 $\mu$m and 90 $\mu$m.

8. The cathode as claimed in claim 7, wherein:

the difference in average density of this coating between said emissive zone and said nonemissive zone is greater than or equal to 0.1 g/cm$^3$.

the difference between the maximum thickness in said nonemissive zone and the minimum thickness in said emissive zone is greater than or equal to 20 $\mu$m.

9. The cathode as claimed in claim 1, wherein the thickness of said substrate is uniform.

10. An electron gun triode suitable for forming at least one electron beam, comprising one cathode K per beam to be formed, a first electrode or "Wehnelt" pierced by a hole facing each cathode, in order to form the base of each electron beam, and a second electrode also pierced by a hole facing each hole in said Wehnelt for passage of the electrons of each beam, wherein each cathode is in accordance with claim 1.

11. The triode as claimed in claim 10, wherein, for each cathode, said emissive zone corresponds to the zone facing the hole in said electrode and said peripheral zone corresponds to the entire cathode emissive coating except for the emissive zone.

12. An electron gun comprising, as electron source, a cathode as claimed in claim 1.

13. A cathode ray tube comprising at least one electron gun as claimed in claim 12.

14. An electron gun comprising, as electron source, a triode as claimed in claim 10.

15. A cathode ray tube comprising at least one electron gun as claimed in claim 14.

* * * * *